US009398643B2

(12) United States Patent
Pateau et al.

(10) Patent No.: US 9,398,643 B2
(45) Date of Patent: Jul. 19, 2016

(54) INDUCTION HEATING METHOD IMPLEMENTED IN A DEVICE INCLUDING MAGNETICALLY COUPLED INDUCTORS

(75) Inventors: Olivier Pateau, Ecuelles (FR); Yves Neau, Montigny sur Loing (FR); Yvan Lefevre, Saint Jean (FR); Philippe Ladoux, Dremil Lafage (FR); Pascal Maussion, Toulouse (FR); Gilbert Manot, Limoges (FR)

(73) Assignees: Electricite de France, Paris (FR); Centre National de la Recherche Scientifique—CNRS, Paris (FR); Institut National Polytechnique de Toulouse, Toulouse (FR)

( * ) Notice: Subject to any disclaimer, the term of this patent is extended or adjusted under 35 U.S.C. 154(b) by 958 days.

(21) Appl. No.: 13/502,551

(22) PCT Filed: Oct. 19, 2010

(86) PCT No.: PCT/FR2010/052216

§ 371 (c)(1),
(2), (4) Date: Apr. 18, 2012

(87) PCT Pub. No.: WO2011/048316

PCT Pub. Date: Apr. 28, 2011

(65) Prior Publication Data

US 2012/0199579 A1 Aug. 9, 2012

(30) Foreign Application Priority Data

Oct. 19, 2009 (FR) ..... 09 57321

(51) Int. Cl.
*H05B 6/08* (2006.01)
*H05B 6/44* (2006.01)
(Continued)

(52) U.S. Cl.
CPC ..... *H05B 6/104* (2013.01); *H05B 6/06* (2013.01); *H05B 6/08* (2013.01); *H05B 6/40* (2013.01); *H05B 6/44* (2013.01)

(58) Field of Classification Search
CPC ..... H05B 6/06; H05B 6/065; H05B 6/08; H05B 6/44; H05B 6/40
USPC ..... 219/650, 671, 661, 662, 663, 664, 665, 219/666, 667, 672
See application file for complete search history.

(56) References Cited

U.S. PATENT DOCUMENTS 2,811,623 A * 10/1957 Guthrie ..... 219/637
3,057,985 A * 10/1962 Biringer ..... 219/662
(Continued)

FOREIGN PATENT DOCUMENTS

ES WO 2009090152 A1 * 7/2009 ..... H05B 6/065
JP 2006-040833 A 2/2006
(Continued)

OTHER PUBLICATIONS

Office Action issued for CA 2,778,379 (May 6, 2014).

*Primary Examiner* — David Angwin
*Assistant Examiner* — John J Norton
(74) *Attorney, Agent, or Firm* — Drinker Biddle & Reath LLP

(57) ABSTRACT

Provided is an induction heating method implemented in a device for heating a metal part, the device including magnetically coupled inductors. Oscillating circuits of the device have at least approximately the same resonance frequency, each inverter is controlled by a control unit to vary amplitude and phase of current passing through the corresponding inductor, the device also including a means for determining said current and an actual temperature profile of said part. The method includes: a) comparing said actual temperature profile with a reference temperature profile and calculating a reference power density profile; b) calculating target currents which the inverters must produce in order for the currents of the inductors to reach suitable target values; c) determining the currents passing through the inductors to compare said currents with said target values and determine correction current deviations, and sending correction instructions to said control units in accordance with said current deviations.

17 Claims, 3 Drawing Sheets

(51) Int. Cl.

| | |
|---|---|
| ***H05B 6/40*** | (2006.01) |
| ***H05B 6/10*** | (2006.01) |
| ***H05B 6/06*** | (2006.01) |

(56) References Cited

U.S. PATENT DOCUMENTS

| | | | | |
|---|---|---|---|---|
| 3,209,114 | A * | 9/1965 | McBrien | 219/671 |
| 3,792,286 | A * | 2/1974 | Meier | 307/58 |
| 4,442,331 | A * | 4/1984 | Watanabe | 219/643 |
| 4,506,131 | A * | 3/1985 | Boehm et al. | 219/662 |
| 4,600,823 | A * | 7/1986 | Hiejima | 219/663 |
| 4,734,556 | A * | 3/1988 | Namiki | 219/110 |
| 5,349,167 | A * | 9/1994 | Simcock | 219/662 |
| 6,121,592 | A * | 9/2000 | Fishman et al. | 219/661 |
| 2003/0019868 | A1 * | 1/2003 | Beer | 219/646 |
| 2006/0289494 | A1 * | 12/2006 | Fishman et al. | 219/663 |
| 2009/0314768 | A1 | 12/2009 | Fishman et al. | |
| 2010/0282740 | A1 * | 11/2010 | Artigas Maestre | H05B 6/065 219/662 |
| 2013/0248520 | A1 * | 9/2013 | Uchida | H05B 6/06 219/662 |
| 2014/0008356 | A1 * | 1/2014 | Uchida | H05B 6/06 219/672 |

FOREIGN PATENT DOCUMENTS

| | | | |
|---|---|---|---|
| JP | 2006-066240 | A | 3/2006 |
| WO | 00/28787 | A1 | 5/2000 |

* cited by examiner

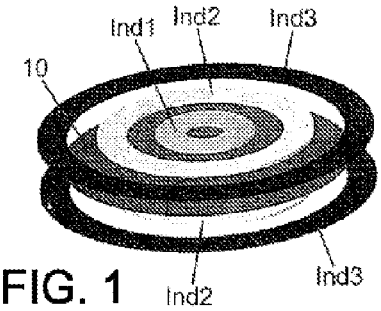
FIG. 1
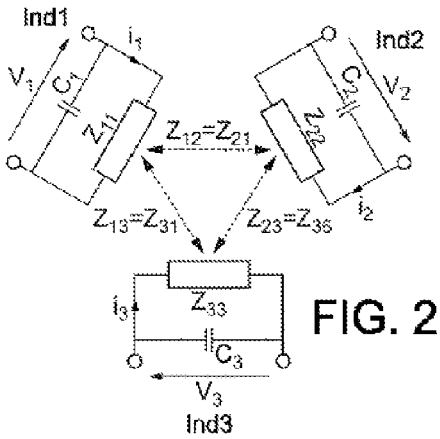
FIG. 2
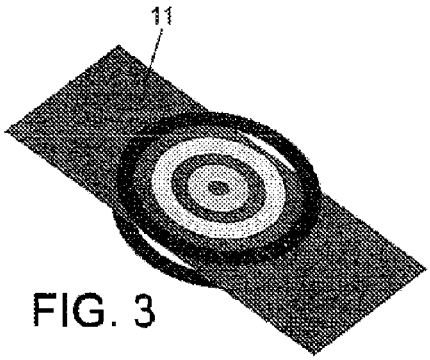
FIG. 3
FIG. 4
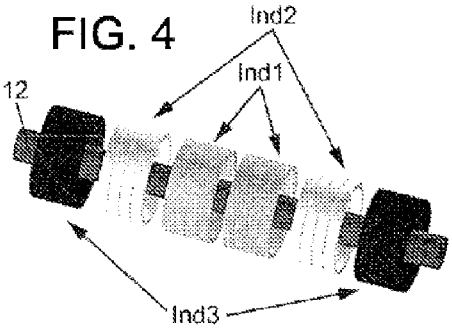
FIG. 5
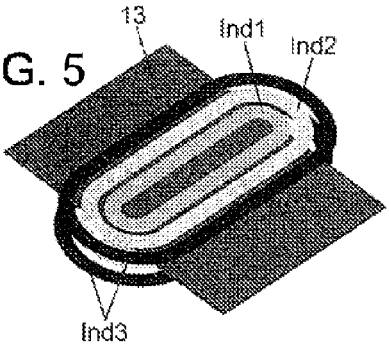
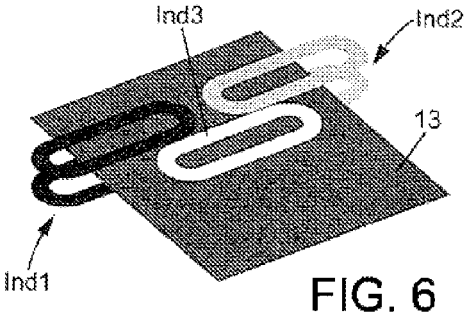
FIG. 6

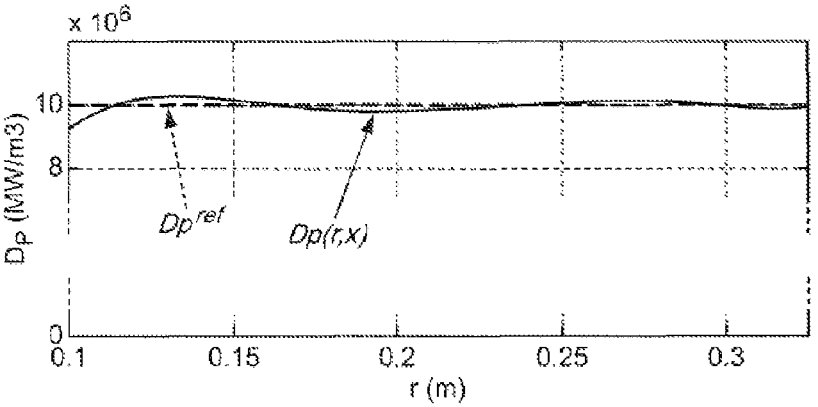
FIG. 7
FIG. 8
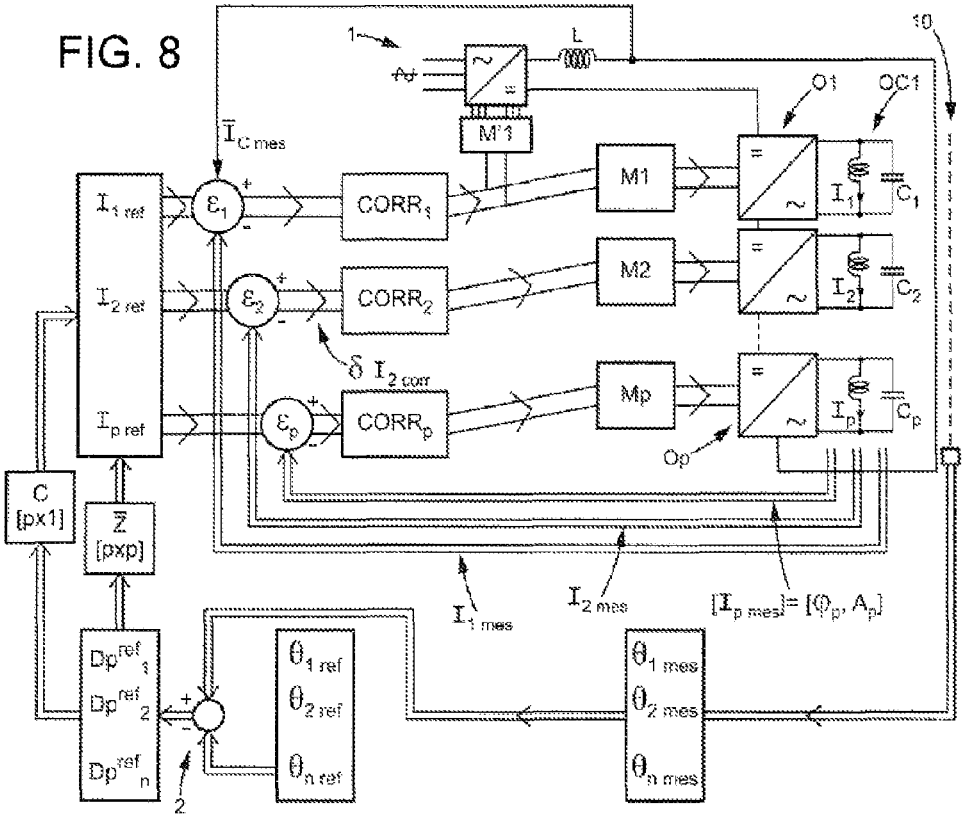

INDUCTION HEATING METHOD IMPLEMENTED IN A DEVICE INCLUDING MAGNETICALLY COUPLED INDUCTORS

CROSS-REFERENCE TO RELATED APPLICATIONS

This application is the U.S. national phase of the International Patent Application No. PCT/FR2010/052216 filed Oct. 19, 2010, which claims the benefit of French Application No. 09 57321 filed Oct. 19, 2009, the entire content of which is incorporated herein by reference.

FIELD

The present invention relates to an induction heating method implemented in a device for heating a metal part such as a sheet or a bar, the device including magnetically coupled inductors. By magnetic coupling is meant that the inductors produce mutual inductions between each other.

BACKGROUND

The more conventional induction heating techniques use configurations which are satisfactory when the parts to be heated are always of the same type and of the same dimensions. However, industry increasingly requires flexibility and productivity. Production lines are required to adapt during continuous operation to the change in position or format of the parts to be heated, and to adapt the desired temperature profile according to this change.

Known technologies make it possible to have control of the heating per injected power zone, but the control of the temperature profile in the heated zones remains related to the geometric design of the coils and to their power supply method, principally by amplitude variation of the currents injected into them. The determination of these currents and the regulation resulting from this contributes greatly to the magnetic coupling existing between the coils because of mutual induction, each powered coil having an effect on all the others. Magnetic coupling makes the control of the temperature profile of the heated part extremely difficult, without considering that there can be harmful repercussions on the frequency generators, for example a breakdown of components.

Patent Application WO 00/28787 A1 describes a system for heating a tubular metal part by induction coils powered by the intermediary of a switching circuit of the dimmer type connected to a power supply source of the inverter type. A control circuit makes it possible to vary the duration of the power injected by the power supply source into each coil in order to heat different zones of the metal part differently in view of a desired temperature profile. The injection of power into a coil is therefore carried out in an "all or nothing" way, i.e. it can be prevented over a cycle corresponding to several periods of the inverter's signal. This system does however have drawbacks, and in particular it makes it possible to control only the average power produced by each coil without being able to control accurately the temperature profile generated by the coils in the heated part. Moreover, this document reveals that the connection of the coils and the inverters must be to a certain degree defined according to the load and to the temperature profile to be achieved. Furthermore, this document does not mention the magnetic couplings between the circuits or the way to be unaffected by them or to take them into account.

SUMMARY

The purpose of the present invention is to overcome these drawbacks and to provide a heating method taking account of the numerous couplings between the different inductors on the one hand and between the inductors and the part to be heated on the other hand, in order to make it possible to control with good accuracy the temperature profile generated by the inductors. A particular purpose of the invention is to be able to adjust the heating to different desired temperature profiles in real time, by acting on the control of the inverters powering the inductors and without it being necessary to adjust the structure of the inductors.

For this purpose, the invention relates to an induction heating method implemented in a device for heating a metal part, the device including magnetically coupled inductors, each inductor being powered by a dedicated inverter associated with a capacitor such as to form an oscillating circuit, said oscillating circuits having at least approximately the same resonance frequency, each inverter being controlled by a control unit such as to vary the amplitude and the phase of the current passing through the corresponding inductor, the device also including means for determining said current as well as means for determining an actual temperature profile of said metal part, said method including the following steps:

a) comparing said actual temperature profile with a reference temperature profile and calculating a profile of the reference power density which the heating device must inject into said part in order to achieve said reference temperature profile;

b) from a matrix of impedances determined by knowledge of the electromagnetic relationships linking said inductors with each other and with said part and by knowledge of vector image functions representing the relationships between the current densities created by the inductors and the currents passing through the inductors, calculating the target currents which the inverters must produce in order for the currents of the inductors to reach target values that are suitable for injecting said reference power density profile into said part;

c) determining the currents passing through the inductors in order to compare them with said target values and to determine current deviations to be corrected, and sending correction instructions to said control units in accordance with said current deviations in order to control the inverters such as to correct the currents passing through the inductors.

Because of these arrangements, accurate control of the temperature profile applied to the heated part is obtained, which is ideal for heating several parts of different sizes and natures using the same device.

In preferred embodiments of a heating method according to the invention, one or other of the following arrangements is implemented in particular:

the capacitances of said capacitors are determined, and said matrix of impedances is associated with a vector of the capacitances;

an initial value of said matrix of impedances is determined for a given initial average temperature of said inductors and of said part, then the matrix of impedances modified for at least one increased value of said average temperature is determined at variable or periodic intervals, and said modified matrix of impedances is used for recalculating said target values;

after having successively carried out steps (a) and (b), step (c) is carried out at least once in order to reduce the current deviations to be corrected, then steps (a), (b) and (c) are reiterated at least once on updating said actual temperature profile with temperature measurements at different heated zones of the part;

for the determination by calculation of said target values in step (b), because of knowledge of said vector image functions, image functions of the power densities are calculated according to the spatial characteristics of the zones of the part into which said power densities are injected, and an optimized vector of the target currents to be determined is calculated by minimizing the difference between each of said image functions of the power densities and a reference power density function corresponding to said reference power density profile;

an inverter having, in comparison with the other inverters, the highest current in the case of a current inverter or the highest voltage in the case of a voltage inverter is chosen as the reference inverter and shift angles are introduced in the controls of the other inverters with respect to a control angle of the reference inverter;

the reference inverter is adjusted with a duty cycle equal to ⅔, in order to reduce the harmonic interference created by this inverter on its neighbours;

the RMS value of the current in said reference inverter is adjusted by acting on a DC power supply which powers the inverters.

Another subject of the invention is an induction heating device comprising:

- magnetically coupled inductors, each inductor being associated with a capacitor in order to form an oscillating circuit, said oscillating circuits having at least approximately the same resonance frequency;
- inverters, each powering a dedicated inductor, each inverter being controlled by a control unit in such a way as to vary the amplitude and the phase of the current passing through the corresponding inductor;

characterized in that it comprises moreover:

- means of determination of the currents passing through the inductors as well as means of determination of an actual temperature profile of a metal part heated by the device;
- means of comparison of said actual temperature profile with respect to a reference temperature profile;
- means of calculating a reference power density profile that the heating device must inject into the part in order to achieve said reference temperature profile;
- means of calculating, based on knowledge of a matrix of the impedances, target currents that the inverters must deliver in order that the inductor currents reach appropriate target values for injecting said reference power density profile into said part;
- means of comparison of the currents passing through the inductors with respect to said target values, capable of determining current deviations to be corrected, and means of processing said current deviations capable of generating correction instructions sent to said control units for controlling the inverters in such a way as to correct the currents passing through the inductors.

In preferred embodiments of a heating device according to the invention, one or the other of the following arrangements is used in particular:

the inverters are powered by the same current source or voltage source power supply, and said means of comparison of said determined currents passing through the inductors include comparator units each receiving determined parameters of a current passing through an inductor and parameters of the corresponding target values and each being connected to a unit for processing said current deviations, one of said comparator units furthermore receiving parameters representative of what said power supply delivers and its associated processing unit being adapted to generate regulation instructions sent to said power supply in order to modify the current or the voltage that it delivers.

BRIEF DESCRIPTION OF THE DRAWINGS

Other features and advantages will become apparent from the following description of non-limitative embodiments, given with reference to the figures in which:

FIG. 1 is a diagrammatic representation of a first example of an induction heating device in which the heating method according to the invention can be implemented, applied to the heating of a fixed metal disk.

FIG. 2 is a diagrammatic representation of a modelling of the system having three coupled inductors shown in FIG. 1, as seen from the power supply.

FIG. 3 is a diagrammatic representation of the induction heating device shown in FIG. 1, applied to the heating of a sheet which is moved.

FIG. 4 is a diagrammatic representation of a second example of an induction heating device, applied to the heating of a metal bar which is moved.

FIG. 5 is a diagrammatic representation of a third example of an induction heating device, applied to the heating of a sheet which is moved.

FIG. 6 is a diagrammatic representation of a fourth example of an induction heating device, applied to the heating of a sheet which is moved.

FIG. 7 is a diagrammatic representation of an image function of the power density calculated from an optimized vector of the currents making it possible to minimize the difference between said function and a reference power density function.

FIG. 8 is a diagrammatic representation of a first embodiment of an induction heating device according to the invention in which the power supply of the inverters is a current source.

DETAILED DESCRIPTION

Figure 9:
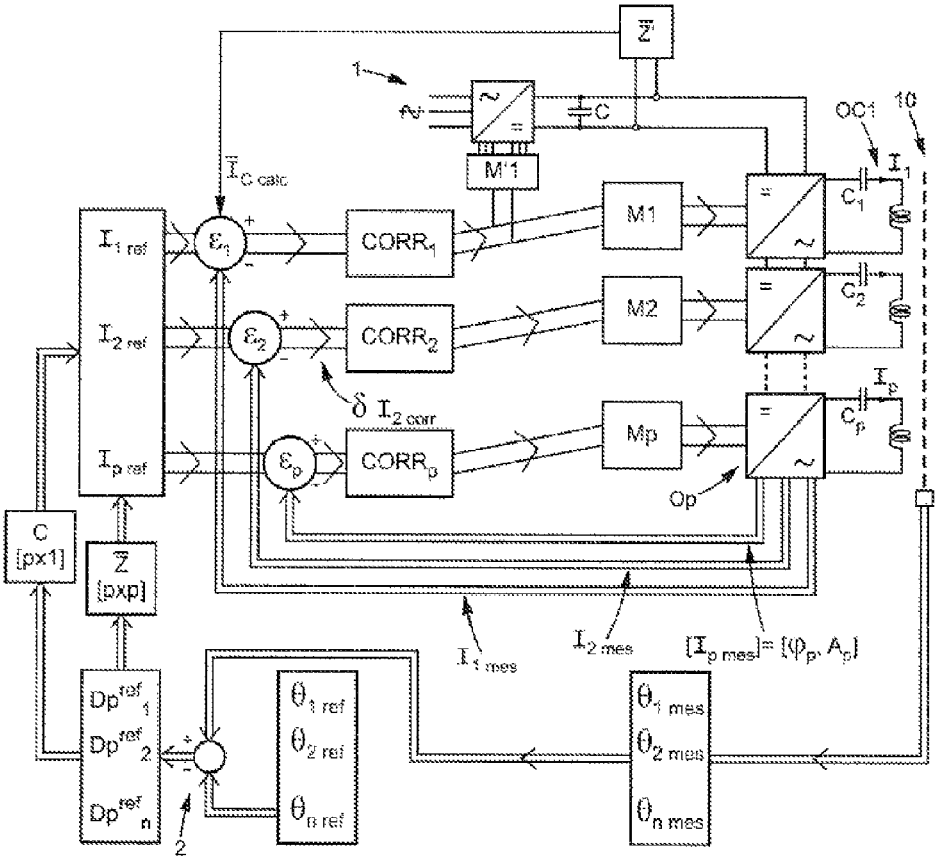
FIG. 9 is a diagrammatic representation of a second embodiment of an induction heating device according to the invention in which the power supply of the inverters is a voltage source.

In FIG. 1, the heating device shown as an example relates to a non-magnetic metal disk configuration heated by transverse flux using three pairs of twin coils, which has the advantage of retaining the axisymmetric aspect of the problem. In order to ensure the symmetry of the whole system, each coil placed on one side of the disk is connected in series with its twin coil on the other side in order to form a single inductor. In this way, the system is invariant in rotation. Moreover, in order to work with the hypothesis of linearity, it will be considered that the electromagnetic materials of the system have a constant and unitary permeability. Each inductor is powered by a dedicated inverter of the series type (voltage inverter) or of the parallel type (current inverter).

In FIG. 2, the modelling of the system in the form of coupled inductors makes it possible to represent the different existing interactions. This modelling also allows the design of the electrical power supply of the inductors and the calculation of the values of the currents that must be injected.

It is necessary to determine the matrix of impedances of the system for each envisaged heating configuration, in order to reflect the magnetic and electrical state of the system for a given geometry. The dimension N of the matrix is given by the number of inductors, in this case N=3.

The matrix of impedances must be complete in order to take account of all of the coupling effects. As the determination of this matrix can be complex, several analytical or digital means, or continuous on-line measurements by injection of particular signals can be used.

Thus modelled, the general equation of the system can be written:

$$\underline{V}=Z\cdot\underline{I}$$

$\underline{V}$: Sinusoidal voltages across the terminals of the inductors;

$\underline{I}$: Currents in the windings of the inductors;

Z: Matrix of impedances of the system.

In the case considered here, the matrix Z can be written in the form:

$$Z=\begin{bmatrix} Z_{11}(\omega) & Z_{12}(\omega) & Z_{13}(\omega) \\ Z_{21}(\omega) & Z_{22}(\omega) & Z_{23}(\omega) \\ Z_{31}(\omega) & Z_{32}(\omega) & Z_{33}(\omega) \end{bmatrix}$$

or also:

$$Z=\begin{bmatrix} R_{11}+jL_{11}\omega & R_{12}+jL_{12}\omega & R_{13}+jL_{13}\omega \\ R_{21}+jL_{21}\omega & R_{22}+jL_{22}\omega & R_{23}+jL_{23}\omega \\ R_{31}+jL_{31}\omega & R_{32}+jL_{32}\omega & R_{33}+jL_{33}\omega \end{bmatrix}$$

$L_{mm}$: represents the self-inductance of each inductor;

$L_{mn}=L_{nm}$: represents the mutual inductances between inductors;

$R_{mm}$: represents the self-resistances of each inductor;

$R_{mn}=R_{nm}$: represents the equivalent resistances due to the induced currents.

With knowledge of the electromagnetic relationships between the coils and the part to be heated, it is possible of proceed with the calculation of the currents to be injected in each of the coils in order to obtain the desired heating.

It should be noted that various conventional configurations or calculation methods try to minimise the non-diagonal coupling terms in order to overcome problems related to the interactions between the coils. Moreover, for many cases where the couplings are weak, the self-resistances of each inductor are often large in comparison with the equivalent resistances due to the induced currents. The conventional methods thus use a simplified matrix, i.e. incomplete, which retains only the diagonal terms. This implies a simplified regulation of the heating, but to the detriment of the accurate control of the temperature profile and of the flexibility of the installation, in particular in the zone located under the coils. On the contrary, the present invention takes account of the complete matrix of impedances of the system in order to improve the determination of the currents to be injected into the coils and therefore improve the control of the temperature profile of the heated part.

In the example described, there are three inductors powered by three different current sources. The determination of the currents to be injected into each coil amounts to determining five unknown variables, the phase of the current in the inductor Ind1 being used as a reference and therefore not unknown. In fact, for a given sheet constituting the part to be heated, the unknowns are:

$I_1$: RMS value of the current in the inductor Ind1, which current is taken as a phase reference;

$I_2$ and $\phi_2$: RMS value of the current in the inductor Ind2, and phase shift of this current with respect to $I_1$;

$I_3$ and $\phi_3$: RMS value of the current in the inductor Ind3, and phase shift of this current with respect to $I_1$.

From the above it is understood that with the complete matrix of impedances taken into account in the present invention, the control of the temperature profile of the heated part must be carried out not only by controlling the amplitudes of the currents in the inductors but also by controlling the phase shifts of these currents with respect to each other, which implies that each inverter is controlled such as to be able to vary the amplitude and the phase of the current passing through the corresponding inductor.

In view of the above relationships, the vector of the unknowns can therefore be written:

$$x=\{I_1,I_2,\phi_2,I_3,\phi_3\}^T \tag{1}$$

It is not possible to determine these unknowns easily by the usual methods of solution. In fact, with the exception of very simple cases, the analytical formulation relating the geometric data, the electrical currents in the inductors, the spatial distribution of the electromagnetic field and the power density at all points is virtually impossible with so many variables. Conventional field calculation software products based on digital techniques of breaking down the studied area into elementary meshes make it possible to know the distribution of the magnetic field and consequently to calculate the power densities in the conductive parts as a function of the currents injected into the inductors. In the present case, the reverse problem arises since it is a matter of knowing if one or more values of the vector x exist, making it possible to obtain a desired power density profile in the part.

By application of the heat equation, it is well known that the power density Dp injected into a conductive part gives a good image of the thermal behaviour of the heated product. For example, in the case of static heating where the speed of displacement of the treated material is zero, knowledge of the instantaneous temperature T of the treated material conventionally requires the temporal solution of a simplified form of the heat equation:

$$\rho\cdot C_p\frac{\partial T}{\partial t}=div(\lambda\cdot gradT)+Dp$$

ρ: represents the density;

$C_p$: represents the specific heat capacity;

λ: represents the thermal conductivity.

Solving this equation involves real time integration, which is not very difficult. Moreover, in the case of "flash" heating, i.e. if the heating time is short such that the thermal diffusion of the heat within the material over this period can be ignored, the expression is further simplified such that:

$$\rho\cdot C_p\frac{\partial T}{\partial t}=Dp \tag{2}$$

A conventional simplified expression is therefore obtained, making it possible to relate the injected power density Dp and the rise in temperature. Thus, the sought power density profile is obtained from the thermal profile desired for the heated part.

In the example with reference to FIG. 1, the system is invariant about the axis of rotation of the disk made of sheet and in the thickness of the sheet. Therefore a single dimension of the disk is taken into account, namely the radial direction of the considered zone of the disk. For the determination of the vector x of the unknowns, it is known that the power density along the radius of the considered zone is calculated by the following equation:

$$Dp(r, x) = \frac{1}{\sigma}|\underline{J}|^2,$$

that is to say:

$$Dp(r, x) = \frac{1}{\sigma}(J_R^2(r, x) + J_I^2(r, x)) \tag{3}$$

where σ represents the electrical conductivity, $\underline{J}$ represents the current density vector defined on the radius r in the part, $J_R$ (r,x) and $J_I$ (r,x) representing the real and imaginary components of this vector as a function of the radius of the considered zone.

The system taken as an example is completely linear, i.e. in particular without ferromagnetic materials or hysteresis. It is therefore possible to apply the superimposition theorem of sources for each of the power supplies of the three inductors. It will be noted that a similar principle can be used in a non-linear system. Image functions of the current densities are thus obtained as a function of the radius r of the considered annular zone of the heated disk, each image function $f_k$ being representative of the relationship between the current density $J_k(r)$, created by an inductor, and the current $I_k$ powering that inductor. These image functions are vectorial and have real and imaginary components defined as follows:

$$f_{kR}(r) = \frac{J_{kR}(r)}{I_k} \qquad f_{kI}(r) = \frac{J_{kI}(r)}{I_k}$$

Finally, in our example with three inductors, the vectorial calculation of the total current density induced in the annular zone of radius r of the disk can be expressed thus:

$$\underline{J}(r, x) = \sum_{k=1}^{3} (f_{kR}(r) + jf_{kI}(r)) \cdot I_k \cdot e^{j\varphi k},$$

where $j^2=-1$, giving:

$$\underline{J}(r, x) = \sum_{k=1}^{3} (f_{kR}(r) + jf_{kI}(r)) \cdot (I_{kR} + jI_{kI})$$

from which $$\underline{J}(r, x) = \underbrace{\sum_{k=1}^{3} (f_{kR}(r) \cdot I_{kR} - f_{kI}(r) \cdot I_{kI})}_{J_R(r,x)} + j\underbrace{\sum_{k=1}^{3} (f_{kR}(r) \cdot I_{kI} + f_{kI}(r) \cdot I_{kR})}_{J_I(r,x)}$$

which can also be written:

$$\underline{J}(r,x)=J_R(r,x)+jJ_I(r,x) \tag{4}$$

A relationship is therefore obtained between the current density vector induced in the considered zone of the part and the vectors of the currents in the inductors. With, on the one hand, the matrix of impedances relating the electrical values between inductors and, on the other hand, the image functions of the current densities in the part, all of the information necessary for the calculation of the vector of the unknowns x from a determined power density profile is available. It will be noted that it is also possible to make use of the vector of the capacitors in this calculation, i.e. the vector of the capacitances of the oscillating circuits, since these capacitances are generally not strictly equal because of manufacturing tolerances and they can moreover drift somewhat. For the calculation, it is possible to use software for solving partial differential equations, with various possible digital techniques such as finite elements, finite differences, finite volumes, boundary integrals, partial element equivalent circuits or any other technique of the same type.

This method has been described for a given example of a relatively simple magnetically coupled system, but it is nevertheless transposable to any more complex and non-symmetrical system. The number of coils is not limited and various shapes and configurations of the coils or of the parts to be heated can be envisaged, as in the examples seen in FIGS. 3 to 6.

Once the image function of the current density is determined, the image function of the power density Dp(r,x) is determined by the relationships given by the above equations (3) and (4). It is advantageous moreover to optimise the vector of unknowns x by calculation. The problem of optimization consists of calculating an optimized vector x making it possible to minimise the difference between the power density image function and a reference power density function $Dp^{ref}$ (r) which corresponds to a reference power density profile that it is sought to inject into the metal disk. This reference power density function for example assumes a constant value if temperature homogeneity over the disk is sought. It is however possible to have a non-constant function in order to obtain particular heating profiles. With the equipment shown in FIG. 1, the applicant carried out tests with different reference power density functions corresponding for example to sinusoidal or triangular profiles in the radial direction of the disk and the results were very satisfactory.

The optimization therefore consists of minimising the function $g(r,x)=|Dp(r,x)-Dp^{ref}(r)|$ whilst fixing high and low limits $X_i^H$ and $X_i^B$ for the sought unknowns. This makes it possible to eliminate, among other things, aberrant solutions or solutions which have no physical reality. The formulation of the optimization problem therefore amounts to minimising g (r, X) with $x=\{x_1, \ldots, x_n\}^T$ and $x_i \in [x_i^B, x_i^H]$, i=1, . . . , n.

After solving the problem, an optimised vector x is obtained, containing all the amplitudes of the vectors of the currents in the inductors and their respective phases, for the given metal disk. One of the results for an example disk of diameter 650 mm, with a reference power density $|Dp^{ref}|$ equal to 10 $MW/m^3$, gives a maximum relative deviation of 3% on the power density image function as shown in Dp(r, x) FIG. 7.

This method of solution can easily be widened in order to take account of several dimensions of a disk, for example three if in addition to the radius account is taken of the angular position and the thickness of the considered zone, whilst also taking account of the equality of the reactive compensation necessary at the terminals of each coil so that the three oscillating circuits oscillate at very close frequencies. The vector with five unknowns has therefore now become a vector with eighteen unknowns, without changing the physical system.

The method explained above for the determination of the optimised vector x is advantageously used in the induction heating method according to the invention, this method being able to be implemented in particular in one or other of the heating devices shown in FIGS. 8 and 9.

FIG. 8 is a diagrammatic representation of a first embodiment of an induction heating device according to the invention, in which the power supply 1 of the inverters is a DC current source.

The heating device comprises magnetically coupled inductors Ind1, Ind2, . . . , Indp, each inductor being powered by a dedicated current inverter O1, O2, . . . , Op, associated with a capacitor $C_1, C_2, \ldots, C_p$, in order to form an oscillating circuit OC1, OC2, . . . , OCp. The current inverters are connected in series with the power supply 1. Each inverter generally comprises bidirectional electronic switches, and is controlled by a control unit also called a modulator M1, M2, . . . , Mp. Each modulator produces control commands for the switches in the form of pulses, and the time shift of these commands makes it possible to vary the amplitude $A_1, A_2, \ldots, A_p$, and the phase $\phi_1, \phi_2, \ldots, \phi_p$, of the current $I_1, I_2, \ldots, I_p$, passing through the corresponding inductor. The variation of the amplitude of the current fundamental at the output of each inverter is carried out by introducing a shift angle into the signal generated by the modulator controlling the inverter. By choosing a reference inverter as explained below, the shift angles on the other inverters can be introduced with respect to a control angle on the reference inverter. The control on the reference inverter can be carried out for example with a duty cycle equal to ⅔ i.e. a control angle of 30°.

The oscillating circuits have at least approximately the same resonance frequency, which makes it possible to maximise the efficiency of the induction since the inductors work substantially at this frequency, and also makes it possible to reduce the losses in the inverters. The periodic control signals of the inverters generated by the modulators therefore have substantially the same frequency. In order to vary the phase $\phi_1, \phi_2, \ldots, \phi_p$, of a current $I_1, I_2, \ldots, I_p$, passing through an inductor, it suffices to time shift the control signal of the corresponding inverter, i.e. to apply the same time shift to the totality of the control commands of the switches of the inverter. This time shift can be equally well done in delay or in advance with respect to the control signal of the inverter of another inductor taken as a reference.

In order to control in real time the power density to be injected into the heated part in order to achieve the sought temperature profile, it is necessary to provide means of determination of the amplitude and phase parameters of the currents passing through the inductors in order to be able to correct the control of the inverters. Means of determination of the amplitude and phase parameters of the currents $I_1$, $I_2, \ldots, I_p$, of the inductors, not shown in the figure, are provided for supplying these parameters to comparator units $\epsilon_1, \epsilon_2, \ldots, \epsilon_p$. These means of determination can consist for example of current transformers each placed in series with an inductor, but other means can be envisaged. It would for example be possible to measure the active current supplied by the inverter to the oscillating circuit and to calculate the current in the inductor using the inductance and capacitance parameters.

Moreover, there is provided means of determination of an actual temperature profile of the heated metal part 10, not shown in the figure, for example by arranging thermocouples on a number n of heated zones and by recording the measured temperatures $\theta_{1\ mes}, \theta_{2\ mes}, \ldots, \theta_{n\ mes}$. It is also possible to determine these temperatures using a thermal camera, or also to proceed by calculations based on the induced currents if, for example, the heated zones are too confined for direct measurement.

The actual temperature profile is for example determined continuously during the heating and is regularly compared with a reference temperature profile $\theta_{1\ ref}, \theta_{2\ ref}, \ldots, \theta_{n\ ref}$, corresponding to the final heating profile desired for the part and previously entered in a memory. This comparison is carried out by a comparator 2, which can be integrated in said memory. The result is processed by a calculator which, from an equation derived from the heat equation and possibly simplified like the above equation (2), calculates the reference power density profile $Dp^{ref}_1, Dp^{ref}_2, \ldots, Dp^{ref}_n$ that the heating device must inject into the part in order to achieve the reference temperature profile. The calculator can consist of a memory in which is entered a table of precalculated reference power density profiles corresponding to different actual temperature profiles for one or more configurations of parts and one or more reference power density profiles.

A calculator establishes target currents that the inverters must deliver in order that the currents in the inductors reach the appropriate target values $I_{1\ ref}, I_{2\ ref}, \ldots, I_{p\ ref}$, for injecting the reference the power density profile into the part. This calculation uses the matrix of impedances Z with the vector image functions $f_k$ and preferably the vector of the previously defined capacitances of the oscillating circuits. The comparator units $\epsilon_1, \epsilon_2, \ldots, \epsilon_p$ compare the parameters of the measured or calculated currents $I_{1\ mes}, I_{2\ mes}, \ldots, I_{p\ mes}$ of the inductors with the target values $I_{1\ ref}, I_{2\ ref}, \ldots, I_{p\ ref}$, and determine the current deviations $\delta I_{1\ corr}, \delta I_{2\ corr}, \ldots, \delta I_{p\ corr}$ to be corrected, also called correction currents. Units $CORR_1$, $CORR_2, \ldots, CORR_p$, for processing the amplitude and phase parameters of these correction currents generate correction instructions sent to the modulators for controlling the inverters in such a way as to correct the amplitudes and the phase shifts of the currents passing through the inductors.

It is understood that by controlling the phase shifts of the currents in the inductors, it is not sought to obtain a zero or constant phase shift. On the contrary, it is sought to use the phase shifts as adjustment parameters for the real time adjustment of the power density to be injected into the heated part, which is made possible by taking into account the complete matrix of impedances as explained above. In other words, the phase shifts are used as temperature profile control parameters. For example, provision can be made to control in real time the phase shifts of the currents in the inductors every quarter-period of the control signals of the inverters generated by the modulators, for finely controlling the temperature according to different profiles, for example a flat profile, or also a profile increasing or decreasing linearly (first order polynomial) or non-linearly (polynomial of order greater than one).

Advantageously, it possible to determine an initial value $Z_{ini}$ of the matrix of impedances Z for a given initial average temperature $\theta_{ini}$ of the inductors and of the part to be heated, then to determine at variable or periodic intervals the modified matrix of impedances $Z_{mod}(\theta)$ for at least one increased value $\theta_{mod}$ of the average temperature $\theta$, and the modified matrix of impedances is used for recalculating the target currents. In the case of variable sampling intervals, the calculation of the target currents can be carried out each time the measured average temperature $\theta$ substantially reaches a new increased value $\theta_{mod}$ from among a series of predetermined values.

Advantageously, the current inverter supplying the inductor of lowest impedance, for example the coil Ind1 in the example of FIG. 1, is chosen as the reference inverter since the current in this inductor, higher than that in the other inductors, is preferably taken as a phase reference. The current inverter having the highest current, or the voltage inverter having the highest voltage in the case where the power supply 1 of the inverters is a voltage source as shown in FIG. 9, can be taken as the reference inverter. Moreover, the reference inverter can be advantageously adjusted to have a duty cycle of ⅔, that is to say it is controlled in such a way as to generate a rectangular wave which is 120° ON and 60° OFF per half-period. The purpose of this is to cancel the third order harmonic and its multiples in order to reduce the harmonic interference created by this inverter on its neighbours. It is understood that the duty cycle of the reference inverter is not necessarily adjusted to the value ⅔. For example, full wave control can be preferred in certain cases.

The RMS value of the current in the reference inverter can be adjusted by action on the DC current or voltage power supply 1. This has the advantage in particular of having a vector of the unknowns (see equation 1 above) in which the phase of the current in the inductor Ind1 has been eliminated, which simplifies obtaining the optimised vector x as in the example described previously. It is understood that it is alternatively possible to adjust the RMS value of the current in the reference inverter by introducing phase shift angles into the control of this inverter. In FIG. 8, with the current $I_1$ being taken as the phase reference, it is advantageous that the corresponding comparator unit $\epsilon_1$ receives the parameters of the current $I_{c\,mes}$ delivered by the DC power supply 1. In this way, the associated processing unit $CORR_1$ is adapted to generate regulation instructions sent to the power supply 1 via a control modulator M'1, in order to modify the current delivered by the inverter O1 to the oscillating circuit OC1, which makes it possible to control the amplitude of this current and therefore to modify the amplitude of the current $I_1$ in the inductor Ind1. In order to heat a metal part with the heating device described above, the method comprising the following steps is used:

a) comparing the actual temperature profile of the part with the predetermined reference temperature profile and calculating the profile of the reference power density which the heating device must inject into the part in order to achieve the reference temperature profile;

b) from a matrix of impedances Z of the system, preferably associated with the vector of the capacitances of the oscillating circuits, and by knowledge of the vector image functions $f_k$, calculating the target currents which the inverters must produce in order for the currents of the inductors to reach the target values that are suitable for injecting the reference power density profile into the part;

c) determining, by measurement or by calculation, the currents passing through the inductors in order to compare them with the target values of these currents and to determine the current deviations to be corrected, and sending correction instructions to the modulators in order to control the inverters such as to correct the currents.

The target currents as well as the measured or calculated currents of the inductors are of course current vectors and consequently not only the amplitude but also the phase is taken into account.

Advantageously, after having successively carried out steps (a) and (b), step (c) is carried out at least once in order to reduce the current deviations to be corrected and then steps (a), (b) and (c) are reiterated at least once on updating the actual temperature profile with temperature measurements in different heated zones of the part.

FIG. 9 is a diagrammatic representation of a second embodiment of an induction heating device according to the invention, in which the power supply 1 of the inverters is a DC voltage source.

The heating device is similar to that of the first embodiment shown in FIG. 8, but the current inverters are connected in parallel with the voltage source. This embodiment has certain advantages, in particular that of reducing the conduction losses in the inverters. On the other hand, the current parameter $I_{c\,calc}$ representative of the current that the power supply 1 delivers to the inverter O1 must be calculated from the power supply voltage using a matrix of impedances Z'.

The invention claimed is:

1. An induction heating method implemented in a device for heating a metal part, the device including magnetically coupled inductors, each inductor being powered by a dedicated inverter and being connected to a capacitor to form an oscillating circuit, said oscillating circuits having at least approximately the same resonance frequency, each inverter being controlled by a control unit to vary the amplitude and the phase of the current passing through the corresponding inductor and to control the current phase and amplitude, the device also determining an actual temperature profile of said metal part, said method comprising the following steps:

a) comparing said actual temperature profile with a reference temperature profile and calculating a profile of the reference power density which the heating device must inject into said part in order to achieve said reference temperature profile;

b) from a matrix of impedances determined by knowledge of the electromagnetic relationships linking said inductors with each other and with said part and by knowledge of vector image functions representing the relationships between the current densities created by the inductors and the currents passing through the inductors, calculating target currents which the inverters must produce in order for the currents of the inductors to reach target values of the currents determined for injecting said reference power density profile into said part;

c) determining the currents passing through the inductors in order to compare them with said target values of the currents and to determine current deviations to be corrected, and sending correction instructions to said control units in accordance with said current deviations in order to control the inverters to correct the currents passing through the inductors; and d) heating the metal part with the corrected currents passing through the inductors with the controlled phases and amplitudes.

2. The heating method according to claim 1, wherein the capacitances of said capacitors are determined, and said matrix of impedances matching with a vector of the capacitances.

3. The heating method according to claim 1, wherein the initial value of said matrix of impedances is determined for a given initial average temperature of said inductors and of said part, then the matrix of impedances modified for at least one increased value of said average temperature is determined at variable or periodic intervals, and said modified matrix of impedances is used for recalculating said target values.

4. The heating method according to claim 3, wherein after having successively carried out steps (a) and (b), step (c) is carried out at least once in order to reduce the current deviations to be corrected, then steps (a), (b) and (c) are reiterated at least once on updating said actual temperature profile with temperature measurements in different heated zones of the part.

5. The heating method according to claim 3, wherein for the determination by calculation of said target values in step (b), because of knowledge of said vector image functions, image functions of the power densities are calculated according to the spatial characteristics of the zones of the part into which said power densities are injected, and an optimized vector of the target currents to be determined is calculated by minimizing the difference between each of said image functions of the power densities and a reference power density function corresponding to said reference power density profile.

6. The heating method according to claim 3, wherein an inverter having, in comparison with the other inverters, the highest current in the case of a current inverter or the highest voltage in the case of a voltage inverter is chosen as the reference inverter and shift angles are introduced in the controls of the other inverters with respect to a control angle of the reference inverter.

7. The heating method according to claim 6, wherein the reference inverter is adjusted with a duty cycle equal to ⅔, in order to reduce the harmonic interference created by this inverter on its neighbors.

8. The heating method according to claim 6, wherein the RMS value of the current in said reference inverter is adjusted by acting on a DC power supply which powers the inverters.

9. The heating method according to claim 1, wherein after having successively carried out steps (a) and (b), step (c) is carried out at least once in order to reduce the current deviations to be corrected, then steps (a), (b) and (c) are reiterated at least once on updating said actual temperature profile with temperature measurements in different heated zones of the part.

10. The heating method according to claim 9, wherein for the determination by calculation of said target values in step (b), because of knowledge of said vector image functions, image functions of the power densities are calculated according to the spatial characteristics of the zones of the part into which said power densities are injected, and an optimized vector of the target currents to be determined is calculated by minimizing the difference between each of said image functions of the power densities and a reference power density function corresponding to said reference power density profile.

11. The heating method according to claim 9, wherein an inverter having, in comparison with the other inverters, the highest current in the case of a current inverter or the highest voltage in the case of a voltage inverter is chosen as the reference inverter and shift angles are introduced in the controls of the other inverters with respect to a control angle of the reference inverter.

12. The heating method according to claim 10, wherein an inverter having, in comparison with the other inverters, the highest current in the case of a current inverter or the highest voltage in the case of a voltage inverter is chosen as the reference inverter and shift angles are introduced in the controls of the other inverters with respect to a control angle of the reference inverter.

13. The heating method according to claim 1, wherein for the determination by calculation of said target values in step (b), because of knowledge of said vector image functions, image functions of the power densities are calculated according to the spatial characteristics of the zones of the part into which said power densities are injected, and an optimized vector of the target currents to be determined is calculated by minimizing the difference between each of said image functions of the power densities and a reference power density function corresponding to said reference power density profile.

14. The heating method according to claim 1, wherein an inverter having, in comparison with the other inverters, the highest current in the case of a current inverter or the highest voltage in the case of a voltage inverter is chosen as the reference inverter and shift angles are introduced in the controls of the other inverters with respect to a control angle of the reference inverter.

15. The heating method according to claim 14, wherein the reference inverter is adjusted with a duty cycle equal to ⅔, in order to reduce the harmonic interference created by this inverter on its neighbours.

16. The heating method according to claim 14, wherein the RMS value of the current in said reference inverter is adjusted by acting on a DC power supply which powers the inverters.

17. The heating method according to claim 15, wherein the RMS value of the current in said reference inverter is adjusted by acting on a DC power supply which powers the inverters.

* * * * *